US005675099A

United States Patent [19]

Granatello

[11] Patent Number: 5,675,099

[45] Date of Patent: Oct. 7, 1997

[54] DRUM WITH MEMBRANE SUPPORT RINGS

[76] Inventor: Tullio Granatello, 2 Via Stoccada, 28010 Cavallirio, Italy

[21] Appl. No.: 580,979

[22] Filed: Jan. 3, 1996

[30] Foreign Application Priority Data

Jan. 10, 1995 [IT] Italy ..... MI95A0035

[51] Int. Cl.[6] ..... G10D 13/02

[52] U.S. Cl. ..... 84/411 R; 84/411 M

[58] Field of Search ..... 84/411 R, 411 A, 84/411 M, 413, 419

[56] References Cited

U.S. PATENT DOCUMENTS 4,549,462 10/1985 Harty et al. ..... 84/413
5,280,742 1/1994 Vergara ..... 84/411 R

*Primary Examiner*—Michael L. Gellner
*Assistant Examiner*—Shih-Yung Hsieh
*Attorney, Agent, or Firm*—Steinberg, Raskin & Davidson, P.C.

[57] ABSTRACT

A drum of the type including a casing (1), with which along at least one end edge (1A) thereof there is associated a membrane (3). With the edge (1A) there is associated at least one annular element (2; 9) allowing the membrane (3) to rest correctly on the edge of the casing (1).

20 Claims, 1 Drawing Sheet

DRUM WITH MEMBRANE SUPPORT RINGS

FIELD OF THE INVENTION

This invention relates to a drum in accordance with the pre-characterising part of the main claim.

BACKGROUND OF THE INVENTION

In the present context a drum means a percussion instrument comprising a casing, of which with at least one end edge there is associated a membrane arranged to be struck or to reverberate. To regulate the tension in the membrane and secure it to the casing, a metal hoop is generally used comprising a plurality of screw ties engaging supports rigidly fixed to the casing.

In known drums the casing edge on which the membrane rests must be suitably shaped, for example such that a first portion facing the casing interior is inclined to the lateral wall of the casing, and a second more outer portion, blending smoothly into the first and on which the membrane rests, is rounded.

This machining of the casing edges, which has necessarily to be precise and done with care, is relatively long and complicated and considerably affects the production time and final cost of the drum.

This machining is even more lengthy and complicated in the case of drums in which the casing consists of a plurality of mutually associated strips (a drum of this type is described for example in patent application No. 19688 A/89), in which case at least the outer edge of the casing has to be further machined at its edge to transform it from polygonal to circular.

In drums of the aforedescribed type, at least two angular bands are fixed to the casing interior to stiffen and further secure the constituent strips of the casing.

It should be noted that the casing of known drums and hence their edge on which the annular element rests is of wooden construction and hence sensitive to temperature and humidity variations. The musical response of the drum therefore varies with environmental conditions.

OBJECTS AND SUMMARY OF THE INVENTION

An object of the present invention is therefore to provide a drum in which it is no longer necessary to shape the casing edge on which the membrane rests, hence reducing production time and costs.

A further object is to provide a drum, the musical response of which is not substantially influenced by environmental variations.

A further object is to provide a drum comprising a support for the insertion of possible accessories, such as a sound-deadening mute.

A further object is to provide a drum of the strip-casing type in which drum assembly is simplified.

These and further objects which will be apparent to the expert of the art are attained by a drum in accordance with the accompanying claims.

The invention will be more apparent from the accompanying figures, which are provided by way of non-limiting example and in which:

DETAILED DESCRIPTION OF THE INVENTION

Figure 1:
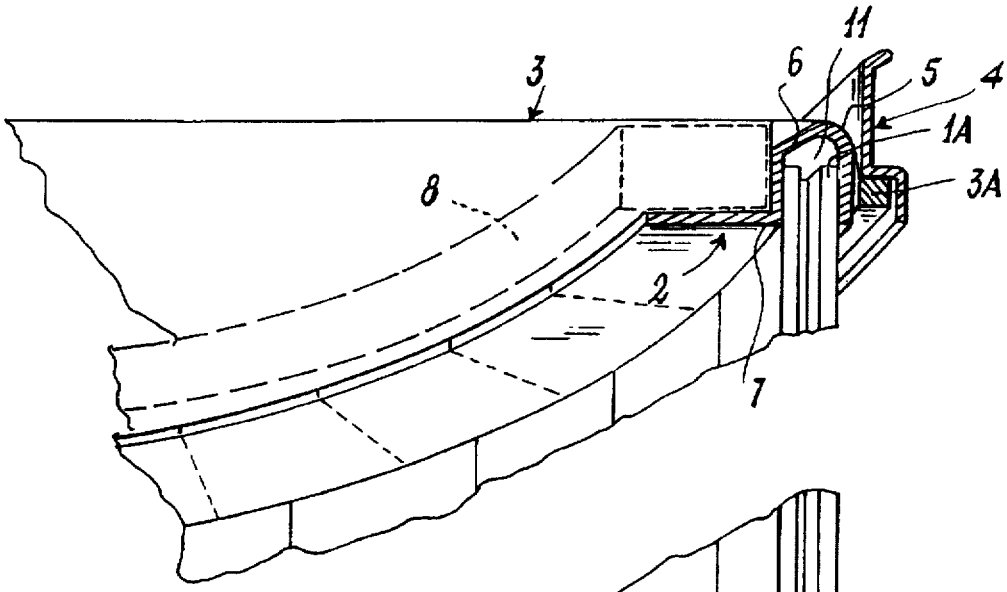
FIG. 1 is a partly sectional schematic perspective view of a drum according to the invention (the drum being shown only partially)
Figure 1:
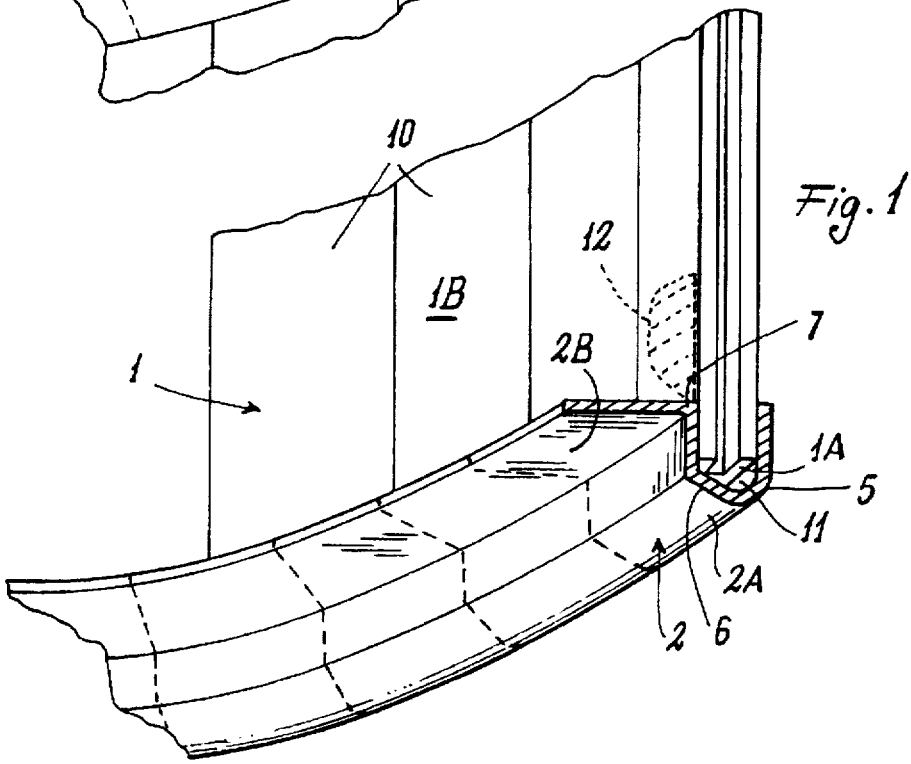

With reference to FIG. 1, a drum according to the invention comprises a usual casing 1 which in the illustrated example is cylindrical-polygonal, two annular elements or rings 2 to be each mounted on the end edge 1A of the casing, a usual membrane 3 resting on the ring 2 in order to be struck or to reverberate, and a usual hoop 4 for tensioning the membrane and securing it to the casing. The casing 1 can be of the type comprising a plurality of strips 10 (as shown in the figures) joined laterally together, or can be in one piece.

In the usual manner the membrane 3 comprises a thickened portion along its perimetral edge 3A to enable it to be tensioned by the hoop 4. This latter, also of conventional type, is secured to the casing by usual screw ties (not shown but conventional) engaged in supports (also not shown but conventional) rigidly connected to the outer face of the lateral wall of the casing. The membrane can be put under tension and the tension regulated by adjusting said ties.

The rings 2 have a first part 2A substantially of U cross-section to be mounted on the edge 1A of the casing, and a flat part 2B extending from and perpendicular to one of the lateral walls of the part 2A.

The part 2A of the ring 2 is shaped externally similar to the free edge of the casing of traditional drums, ie, as for example shown in FIG. 1, such as to present an outer rounded portion 5 on which the membrane rests, and an inner portion 6 blending smoothly into the first and inclined to the lateral wall 1B of the casing 1.

Figure 3A:
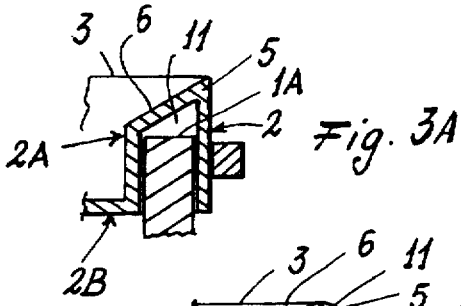
FIGS. 3A, 3B are schematic cross-sections through two modifications of a detail of the invention
Figure 3B:
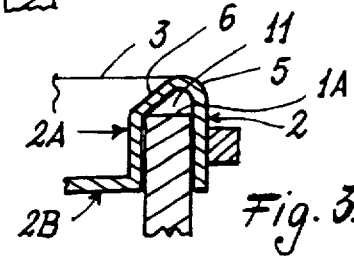

It should be noted that, as shown in FIGS. 3A, 3B, the part 2A could also be shaped differently from that described, provided it always comprises at least two parts 5, 6 blending smoothly into each other, namely an outer first part 5 on which the membrane rests and a second part 6 on which the membrane does not rest.

A conventional filling material (not shown), for example a usual adhesive, is advantageously inserted into the recess 11 bounded by the edge 1A of the casing and the ring 2.

The flat part 2B extends from the inner free edge 7 of the U-shaped part 2A and acts as a stiffening ring for the casing and as a support for a possible accessory to be inserted into the drum, for example a mute 8 (shown by dashed lines in the figures). In the case of drums with a strip-type casing, the ring 2 in addition to dispensing with the need for machining the casing edges 1A is able, by means of its part 2A, to act as an element for mutually retaining the strips and for avoiding the need to shape the outer face of the casing along its edges 1A to transform it from polygonal to circular.

Consequently by virtue of the rings 2, it is no longer necessary to associate annular casing stiffening bands with the casing interior.

The ring 2 can be constructed of any material suitable for the purpose, for example of plastic or metal.

It should be noted that because of the ring 2, in the drum according to the invention the membrane 3 is isolated from the casing 1, so that the musical response of the drum is not substantially influenced by changes to the casing induced by temperature or humidity variations.

Figure 2:
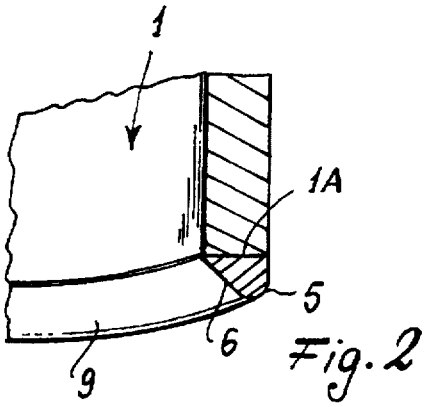
FIG. 2 is a schematic sectional perspective view of a modification of a detail of the drum according to the invention.

Finally it should be noted that the aforedescribed embodiment is provided by way of non-limiting example and that numerous modifications are possible, all falling within the same inventive concept. For example, the annular element or ring 2 could be without the flat part 2B, which is not required for a drum with a one-piece casing, or again the ring could be formed in a number of parts for example of circular arc shape joined together, or could have a shape different from the aforedescribed. For example instead of having a U-shaped section for mounting on the casing edge 1A, the ring could comprise only one part 9 to be rested on the casing edge 1A and shaped in the previously described manner as shown in FIG. 2. Finally, instead of being flat and perpendicular to the casing, the part 2B could be of rounded shape as shown by dashed lines 12 in FIG 1.

I claim:

1. In a drum of the type comprising a casing having an exterior surface, an interior surface and an end edge extending between said exterior and interior surfaces, and a membrane associated with said end edge, the improvement comprising, at least one annular element interposed between said end edge and said membrane, said at least one annular element being arranged to cover said end edge thereby allowing the membrane to rest indirectly on said end edge of the casing and wherein a portion of said at least one annular element extends over said exterior surface of said casing adjacent said end edge.

2. A drum as claimed in claim 1, characterised in that the annular element (2; 9) is shaped such that that side thereof substantially facing the membrane presents at least two portions (5, 6) blending smoothly into each other, namely a first portion (5), more outward with respect to the drum casing, on which the membrane (3) rests, and a second portion (6), more inward, on which the membrane (3) does not rest.

3. A drum as claimed in claim 1, characterised in that the annular element (2; 9) has a first part (5) of rounded shape, the membrane (3) resting on said first part.

4. A drum as claimed in claim 3, characterised in that said annular element (2; 9) has a second part (6) which is flat and is inclined to the lateral wall (1B) of the casing in the direction towards the casing interior, said inclined flat part (6) blending smoothly into the rounded first part (5) on which the membrane (3) rests.

5. A drum as claimed in claim 1, characterised in that the annular element (2) is substantially of U cross-section so as to be able to be at least partly mounted on the edge (1A) of the casing (1), the base of said U comprising at least one rounded part (5) to act as a support for the membrane (3).

6. A drum as claimed in claim 5, characterised in that the base of said U comprises a flat second part (6) which blends smoothly into the first and is inclined to the lateral wall (1B) of the casing (1).

7. A drum as claimed in claim 1, characterised in that the annular element (2) comprises a part (2B) having at least one portion in contact with the inner face of the lateral wall of the casing (1) in order to stiffen the casing.

8. A drum as claimed in claim 7, characterised in that the stiffening part is a flat annular wall (2B) substantially perpendicular to the lateral wall (1B) of the casing (1).

9. A drum as claimed in claim 1, characterised in that a filling material is provided in a recess (11) bounded by the casing edge (1A) and the annular element (2).

10. A drum as claimed in claim 9, characterised in that the filling material is an adhesive.

11. A drum as claimed in claim 1, characterised in that the annular element (2) comprises a plurality of circular arc-shaped parts to be joined together.

12. A musical drum, comprising:

a casing defining an interior opening and having an exterior surface, an interior surface and an edge extending between said exterior and interior surfaces;

at least one annular member arranged in connection with said casing to cover said edge of said casing such that a portion of said at least one annular member extends over said exterior surface of said casing adjacent said edge; and a membrane extending over said at least one annular member such that said membrane substantially covers said interior opening of said casing and rests indirectly on said edge.

13. A drum in accordance with claim 12, wherein said at least one annular member comprises a first portion contacting said membrane and a second portion joined with said first portion, said second portion being situated away from said membrane.

14. A drum in accordance with claim 13, wherein said first portion of said at least one annular member has a rounded shape.

15. A drum in accordance with claim 12, wherein an edge of said membrane encircles said portion of said at least one annular member in engagement with said exterior surface of said casing and thus encircles said exterior surface of said casing adjacent said edge.

16. A drum in accordance with claim 12, wherein said at least one annular member is substantially U-shaped and is at least partly mounted on said edge of said casing, said U-shaped annular member comprising at least one rounded part arranged to engage with said membrane.

17. A drum in accordance with claim 13, wherein said casing is defined by a lateral wall, said edge being defined on said lateral wall, and wherein said at least one annular member comprises a third portion coupled to said second portion, said third portion being substantially perpendicular to said lateral wall and having at least one part in contact with an inner face of said lateral wall and wherein said third portion constitutes means for supporting a sound altering component.

18. A drum in accordance with claim 12, wherein said casing is formed of wood.

19. A drum in accordance with claim 12, further comprising a hoop surrounding said at least one annular member for tensioning said membrane and for securing said membrane to said at least one annular member.

20. A drum in accordance with claim 19, wherein said membrane comprises a thickened portion along its edge, said hoop and said at least one annular member being structured and arranged to retain said thickened portion to therefore tension said membrane.

* * * * *